US007980319B2

(12) United States Patent
Maeda

(10) Patent No.: US 7,980,319 B2
(45) Date of Patent: Jul. 19, 2011

(54) MOTOR GRADER

(75) Inventor: Kenichi Maeda, Iwata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 11/997,756

(22) PCT Filed: Jul. 20, 2006

(86) PCT No.: PCT/JP2006/314367

§ 371 (c)(1),
(2), (4) Date: Apr. 14, 2008

(87) PCT Pub. No.: WO2007/015376

PCT Pub. Date: Feb. 8, 2007

(65) Prior Publication Data

US 2008/0185162 A1 Aug. 7, 2008

(30) Foreign Application Priority Data

Aug. 3, 2005 (JP) ..... 2005-225238

(51) Int. Cl.
*E02F 3/00* (2006.01)

(52) U.S. Cl. ..... 172/789; 172/795

(58) Field of Classification Search ..... 172/780–799; 37/381

See application file for complete search history.

(56) References Cited

U.S. PATENT DOCUMENTS 2,258,890 A * 10/1941 Gustafson ..... 172/793
2,655,743 A * 10/1953 Ross ..... 172/793
3,164,915 A * 1/1965 Benner et al. ..... 172/797
3,415,169 A * 12/1968 Naddell ..... 92/85 R
3,415,327 A * 12/1968 Hanser ..... 172/793
3,454,109 A * 7/1969 Roberts ..... 172/781
3,454,110 A * 7/1969 Hanser ..... 172/793
3,512,589 A * 5/1970 Ulrich ..... 172/786

(Continued)

FOREIGN PATENT DOCUMENTS

CN 1086588 A 5/1994
JP 62-170619 7/1987

(Continued)

OTHER PUBLICATIONS

Canadian Office Action issued Oct. 7, 2010 in co-pending Canadian Application No. 2,617,684, 4 pges.

*Primary Examiner* — Robert E Pezzuto
*Assistant Examiner* — Matthew D Troutman
(74) *Attorney, Agent, or Firm* — Fish & Richardson P.C.

(57) ABSTRACT

A motor grader including lift cylinders is described. Each one of lift cylinders is connected to a lifter bracket through first support means, and each other ends of the lift cylinders is connected to a forward position compared to a rear in portion in a draw bar, through second support means. Each one ends and the other end of the lift cylinders are offset from each other with respect to a front-rear direction of the motor grader as viewed from above the motor grader, thereby disposing the pair of lift cylinders inclined in the front-rear direction of the motor as viewed from a side of the motor grader. With this structure, it is possible to obtain the motor grader in which a height position of each end of the lift cylinders can be substantially equal to a height position of the lifter bracket as viewed from the side of the motor grader, and a visibility hindrance by the pair of lift cylinders can extremely be lowered.

4 Claims, 13 Drawing Sheets

U.S. PATENT DOCUMENTS

| | | | | | |
|---|---|---|---|---|---|
| 3,550,692 | A | * | 12/1970 | Hart | 172/793 |
| 3,643,355 | A | * | 2/1972 | Eiger | 37/419 |
| 3,677,350 | A | * | 7/1972 | Johnson et al. | 172/789 |
| 3,739,861 | A | * | 6/1973 | Johnson et al. | 172/793 |
| 3,858,661 | A | * | 1/1975 | Hallam et al. | 172/1 |
| RE28,979 | E | * | 9/1976 | Long et al. | 172/4.5 |
| 4,016,936 | A | * | 4/1977 | Easterling et al. | 172/796 |
| 4,246,972 | A | * | 1/1981 | Halmosi et al. | 172/789 |
| 4,340,119 | A | * | 7/1982 | MacDonald | 172/789 |
| 4,807,461 | A | | 2/1989 | Brimeyer et al. | |
| 6,278,955 | B1 | | 8/2001 | Hartman et al. | |
| 6,364,028 | B1 | * | 4/2002 | Ferrell et al. | 172/1 |
| 6,725,946 | B2 | * | 4/2004 | Howell, Jr. | 173/184 |

FOREIGN PATENT DOCUMENTS

| | | | |
|---|---|---|---|
| JP | 50-75703 | A | 3/1993 |
| JP | 5-94353 | A | 12/1993 |
| JP | 2000-170203 | A | 6/2000 |
| JP | 39-21035 | | 12/2001 |
| JP | 2004-190232 | A | 8/2004 |
| WO | WO93/19302 | | 9/1993 |

* cited by examiner (a)

(b)

MOTOR GRADER

TECHNICAL FIELD

The present invention relates to a motor grader, and more particularly, to a disposition of a pair of lift cylinders which vertically moves a draw bar. A term "lifter bracket" used in claims and specification of the present invention is used as a generic name of a bracket which supports a lift cylinder on a front frame.

BACKGROUND ART

Generally, a motor grader is a wheeled construction machine which levels land such that a road surface, a ground surface and the like become smooth ground surface. A blade for leveling a ground surface can move in the vertical direction, incline in the vertical direction, incline in the front-rear direction of the vehicle, slide in the right-and -left direction of the vehicle, and turn around a predetermined pivot shaft.

Generally, the motor grader has a structure as shown in a perspective view in FIG. 10. FIG. 10 shows a conventional example of the present invention. As shown in FIG. 10, one end of a draw bar 103 is connected to a front end of a front frame 102 of a motor grader 101 such that the draw bar 103 can swing around the one end thereof.

A swing circle 109 is mounted on the draw bar 103 such that the swing circle 109 can swing, and a blade 105 is supported by the swing circle 109 such that the blade 105 can slide in the lateral direction. One ends of a pair of left and right lift cylinders 111*a* and 111*b* are turnably connected to the draw bar 103. Portions of the lift cylinders 111*a* and 111*b* which are turnably connected to lifter brackets 107 are close to the draw bar 103. The lifter brackets 107 are mounted on the front frame 102.

A draw bar shift cylinder 112 is disposed between the lifter bracket 107 and the draw bar 103. The blade 105 is supported by the swing circle 109 through a guide (not shown). A side shift cylinder (not shown) is disposed between the blade 105 and the guide. The blade 105 can slide in the lateral direction of the vehicle by expansion and contraction of the side shift cylinder.

By expanding and contracting the pair of left and right lift cylinders 111*a* and 111*b* in synchronization with each other, the draw bar 103 can be moved upward and downward. That is, the blade 105 can be moved vertically. If the pair of left and right lift cylinders 111*a* and 111*b* is expanded and contracted differently from each other, the draw bar 103 can be inclined in the vertical direction. That is, the draw bar 103 can be inclined in a state where one end of the blade 105 is raised and the other end thereof is lowered.

By expanding and contracting the draw bar shift cylinder 112, the draw bar 103 can be swung in the right-and-left direction of the vehicle. The swing circle 109 is swung by a hydraulic motor 116. By swinging the swing circle 109, the blade 105 supported by the swing circle 109 can swing in the clockwise direction or the counterclockwise direction as viewing the draw bar 103 from above of the vehicle. The swinging angle of the swing circle 109 may exceed 360° and the swing circle 109 may continuously swing if necessary.

A tilt angle of the blade 105 with respect to the ground surface can be varied by expanding and contracting a tilt cylinder (not shown). Since the motor grader has such a structure, the blade 105 can control the up-and-down movement, up-and-down inclination, right-and-left swing, rotation, right-and-left sliding movement and tilting movement of the blade 105 with respect to the vehicle through the draw bar 103 and the swing circle 109.

Patent Document 1: Japanese Patent Laid-open Publication No. 2004-190232

DISCLOSURE OF THE INVENTION

Problem to be Solved by the Invention

In order to precisely and efficiently finish a road surface or a ground surface by operating a motor grader, an operator carefully watches an operating status during operating and a forward operating place where the operating is to be carried out. Therefore, it is strongly required that operation visibility and forward visibility of the motor grader are excellent.

In the conventional motor grader shown in Patent Document 1, however, the left and right two lift cylinders which lift up and down the draw bar largely project above the upper surfaces of the lifter brackets 107 in front of the driver's seat. FIG. 11 is a schematic view of the forward visibility as viewed from the driver's seat in the conventional motor grader.

As can be seen from FIG. 11, the two lift cylinders 111*a* and 111*b* which can be seen directly in front of the driver are unsightly in the operation visibility and forward visibility. A reference symbol 110 represents a steering wheel, and a reference symbol 117 represents a window frame of an operating seat. A reference symbol 118 represents a forward road surface.

The pair of lift cylinders 111*a* and 111*b* function as cylinders which lift up and down the draw bar 103. However, when the draw bar shift cylinder 112 shown in FIG. 10 is extended, and the draw bar 103 in a horizontal direction is swung, the pair of lift cylinders 111*a* and 111*b* are expanded and contracted in synchronization with right-and-left swing of the draw bar 103.

This movement will be explained using FIG. 12. FIG. 12 is a schematic view of positional relation between the draw bar 103, the pair of lift cylinders 111*a* and 111*b* and the lifter bracket 107 in the conventional motor grader. The draw bar 103 can be swung in the horizontal direction and the up-and-down direction around a rotation center 124. Solid lines show a neutral state of the draw bar 103, and alternate long and two short dashes lines show a state where the draw bar 103 swings leftward of the vehicle on a horizontal plane.

When the draw bar 103 is in its neutral state, the pair of lift cylinders 111*a* and 111*b*,each has the same length. If the draw bar 103 swings in the leftward of the vehicle from this state and assumes the state shown with the alternate long and two short dashes lines, the pair of lift cylinders 111*a* and 111*b*, each extends respectively and follows the swinging movement of the draw bar 103. In order to accommodate the extending amount of piston rods of the respective lift cylinders 111*a* and 111*b* in the respective cylinders, it is necessary that the lift cylinders 111*a* and 111*b*, each be formed long so as to permit strokes thereof.

FIG. 13 is a schematic view of the draw bar 103 in which the pair of left and right lift cylinders 111*a* and 111*b* is expanded and contracted differently and the draw bar 103 is inclined in an up-and-down direction. In FIG. 13, solid lines, as in FIG. 12, show a neutral state of the draw bar 103, and alternate long and two short dashes lines show a state where the draw bar 103 is turned around a rotation axis 129 shown with an alternate long and short dash line. A dotted line shows a moving locus 130 in a connecting point between the draw bar 103 and the lift cylinders 111*a* and 111*b*.

Portions of the pair of lift cylinders 111*a* and 111*b* which is connected to the lifter bracket 107 are located as close to the draw bar 103 as possible so that a radius of the moving locus 130 shown with the dotted line does not become large.

Therefore, lower ends of the pair of lift cylinders 111*a* and 111*b* on the side of the draw bar 103 are connected to the lifter brackets 107. Therefore, as shown in FIG. 11, the ends of the pair of lift cylinders 111*a* and 111*b* projecting from the lifter brackets 107 hinder the operation visibility and forward visibility.

When the forward visibility is not excellent due to the pair of lift cylinders 111*a* and 111*b*, an operator must stand up even during normal running state to secure the visibility or must drive the motor grader while moving his or her body to the left or right to visually check forward from a diagonal angle.

An object of the present invention is to extremely reduce the visibility hindrance caused by the pair of lift cylinders which hinders the forward visibility and operation visibility in the conventional motor grader, and to provide a motor grader capable of securing a lateral swinging amount of the draw bar, an inclination amount of the draw bar in the up-and-down direction and the like as in the conventional motor grader.

Means for Solving Problem

That is, the first invention of the present application is most characterized in that in a motor grader comprising: a front frame on which a lifter bracket is disposed; a draw bar which has one end turnably connected to the front frame and rotatably supports a blade at its lower surface; and a pair of left and right lift cylinders on a side of the other end of the draw bar, the lift cylinders lifting up and down the draw bar, one ends of the respective lift cylinders are connected to the lifter bracket through first support means having a freedom degree of two shafts or more, and the other ends of the respective lift cylinders are connected to the draw bar through second support means having a freedom degree of two shafts or more.

The second invention of the present application is most characterized in that in a motor grader comprising: a front frame on which a lifter bracket is disposed; a draw bar which has one end turnably connected to the front frame and rotatably supports a blade at its lower surface; and a pair of left and right lift cylinders on a side of the other end of the draw bar, the lift cylinders lifting up and down the draw bar, one ends of the respective lift cylinders are connected to the lifter bracket through first support means having a freedom degree of two shafts or more, and the other ends of the respective lift cylinders are connected to the draw bar through second support means having a freedom degree of two shafts or more, and the one ends and the other ends of the respective lift cylinders are offset in a front-rear direction of the motor grader as viewed from above the motor grader.

The second invention of the application can be most characterized in that an offset relation between one ends and the other ends of the lift cylinders is specified.

The first or second invention of the application can be mainly characterized in that a disposition relation between the pair of support brackets which supports the lift cylinders through the first support means and the respective lift cylinders is specified.

The first or second invention of the application can be mainly characterized in that the structures of the lift cylinders and the structures of the first support means and second support means are specified.

Effect of the Invention

According to the first invention of the application, since portions of the lift cylinders connected to the lifter bracket are the ends, the lengths of the lift cylinders projecting upward from the connecting portions can be reduced. With this, wide visibility can be secured in the forward visibility and operation visibility in the motor grader, and the operation efficiency can largely be enhanced.

Since the visibility hindering portions of the lift cylinders can extremely be reduced, it is possible to prevent light from a work lamp or a headlamp from reflecting on the lift cylinders and entering into eyes of an operator. Further, since the projection amounts from the lifter bracket can extremely be reduced which is different from the conventional lift cylinders, interference between a surrounding obstruction and the lift cylinder can be avoided in a bank operating position of the blade.

Further, the connection point between the lift cylinder and the draw bar can be disposed on a forward side of the vehicle compared to a connection point between the lift cylinder and the lifter bracket. With this structure, the connection point between the lift cylinder and the draw bar can be disposed at a location far inside of the vehicle body with respect to the triangular draw bar, and visibility on the side of the front wheels can be enhanced.

According to the second invention of the application, the lift cylinders can be disposed in an inclined state in the front-rear direction of the motor grader. Therefore, in addition to the effects of the first invention, wider visibility can be secured in the forward visibility and the operation visibility in the motor grader, and the operation efficiency can be largely enhanced.

EXPLANATION OF REFERENCE NUMERALS

Figure 1:
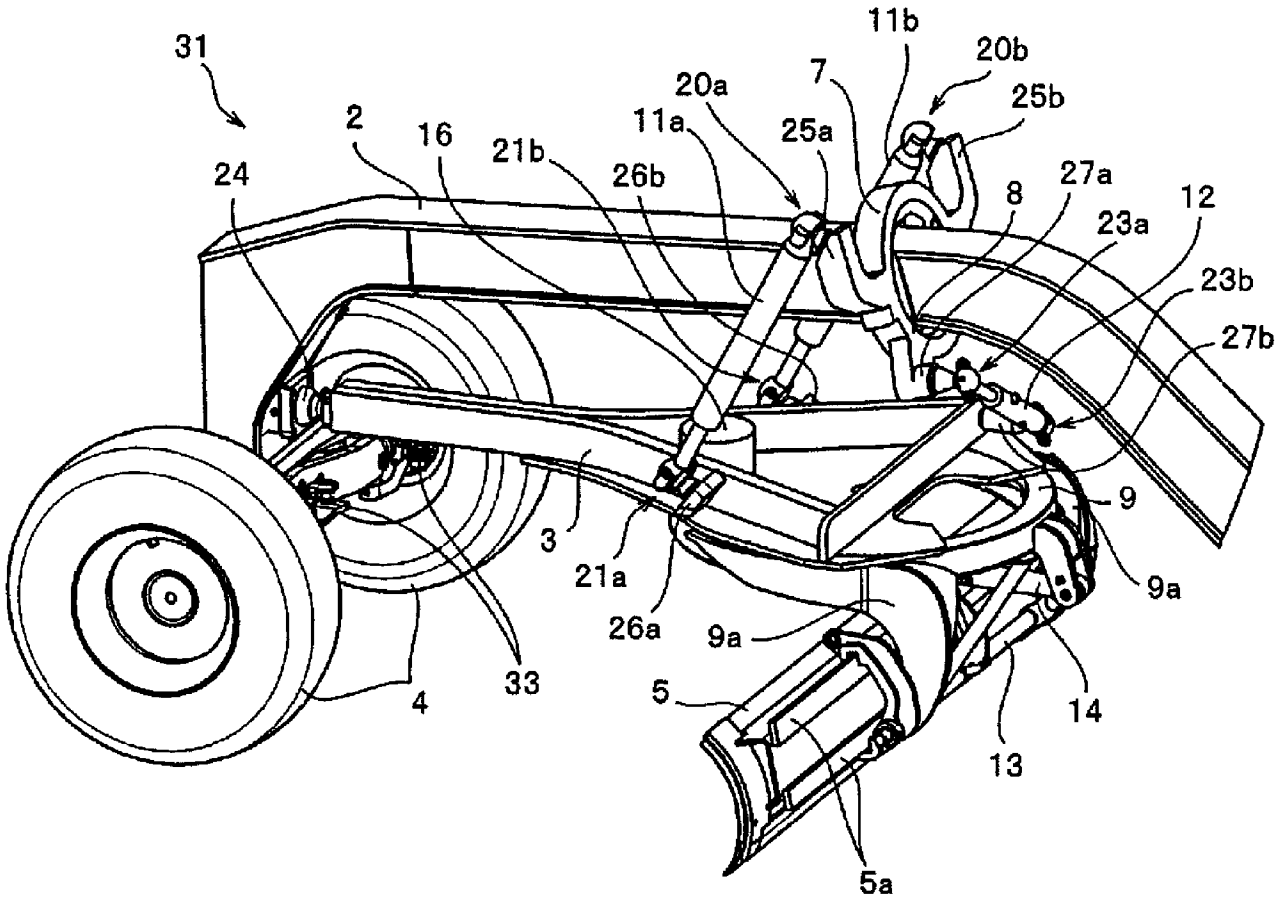
FIG. 1 is a perspective view of an operating machine section of a motor grader (embodiment 1).

2 . . . front frame
3 . . . draw bar

5 . . . blade
7 . . . lifter bracket
8 . . . draw bar shift bracket
9 . . . swing circle
11*a*, 11*b* . . . lift cylinder
12 . . . draw bar shift cylinder
20*a*, 20*b* . . . first support means
21*a*, 21*b* . . . second support means
23*a*, 23*b* . . . third support means
24 . . . support means
28 . . . rotation center
29 . . . rotation axis
30 . . . turning locus
31 . . . operating machine
35 . . . lifter bracket
36*a*, 36*b* . . . support member
37 . . . link member
41 . . . holding body
42 . . . positioning pin
45 . . . lifter bracket
46*a*, 46*b* . . . support member
47*a*, 47*b* . . . side surface
49*a*, 49*b* . . . side surface
102 . . . . front frame
103 . . . draw bar
105 . . . blade
107 . . . lifter bracket
109 . . . swing circle
111*a*, 111*b*, 111*b* . . . lift cylinder
112 . . . draw bar shift cylinder
124 . . . rotation center
128 . . . rotation center
129 . . . rotation axis

MODE FOR CARRYING OUT THE INVENTION

Preferable embodiments of the present invention will be explained concretely based on the accompanying drawings below. As the structure of the motor grader of the present invention, shapes and disposition structures which can achieve the objects of the invention can be employed in addition to shapes and disposition structures explained below. Therefore, the present invention is not limited to the embodiments explained below, and the invention can variously be modified.

Embodiment 1

Figure 10:
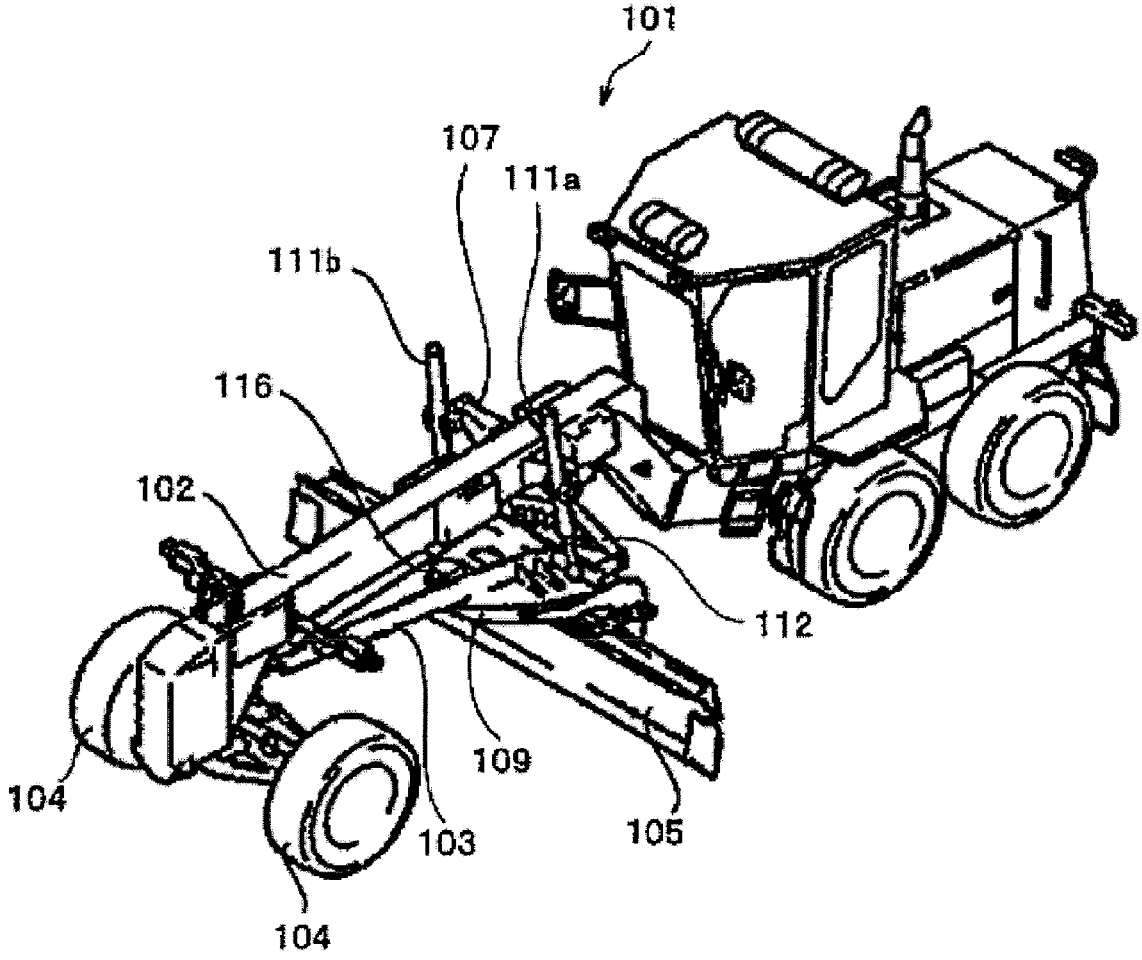
FIG. 10 PRIOR ART
FIG. 10 is a perspective view of a motor grader (conventional example).

FIG. 1 shows an outward appearance of an operating machine 31 of a motor grader as viewed from the side. The entire structure of this motor grader is similar to a structure in FIG. 10 shown as the conventional example. That is, as shown in FIG. 10, rear wheels and a driver's seat are provided on rear portions of a vehicle body of the motor grader, and front wheels and an operating machine are provided on front portions of the vehicle body. The front portion of the vehicle body is connected to the rear portion of the vehicle body by a front frame. The front frame is connected to the rear portion of the vehicle body, and the front frame is connected to the rear portion of the vehicle body so that it can turn in the horizontal direction with respect to the rear portion of the vehicle body.

The entire structure of the motor grader using FIG. 10 is a structure of a general motor grader. As will be described later, the present invention is characterized in disposition structure of a pair of lift cylinders 11*a* and 11*b*. Hence, front wheels 4 and the operating machine 31 are shown in FIG. 1, and a support structure of a front frame 2 and the vehicle rear portion, and the rear portion of the vehicle are omitted.

In the present invention, structures other than the disposition structure of the pair of lift cylinders 11*a* and 11*b* are not limited to those explained below, and other structure used as a motor grader can be employed.

As shown in FIG. 1, a rear end of a front frame 2 is connected to a rear portion (not shown) of a vehicle such that the front frame 2 can turn in the horizontal direction. A front end of the front frame 2 supports a pair of front wheels 4 through a front axle device 33. The front frame 2 connects a tip end of a draw bar 3 through support means 24. The draw bar 3 is disposed such that it can swing around the up-and-down direction, the right-and-left direction and the support means through the support means 24.

The support means 24 includes later-described first support means 20*a* and 20*b*, second support means 21*a* and 21*b*, third support means 23*a* and 23*b* and a turning mechanism which permits turning movements of at least two shafts. A ball joint mechanism, a trunnion mechanism and a universal joint mechanism can be used as turning mechanisms constituting the support means 20 to 24. In FIG. 1, support means which is the ball joint mechanism is shown as each of the support means 20 to 24.

The pair of lift cylinders la and 11*b* is disposed between the draw bar 3 and the front frame 2. One ends of the lift cylinders 11*a* and 11*b* are connected to a lifter bracket 7 supported by the front frame 2 through the first support means 20*a* and 20*b*, respectively. The first support means 20*a* and 20*b* are disposed between support brackets 25*a* and 25*b* disposed in the right-and-left direction of the vehicle from the lifter bracket 7 and one ends of the lift cylinders 11*a* and 11*b*.

In FIG. 1, the configuration, in which the ends of the respective lift cylinders 11*a* and 11*b* are connected to the lifter bracket 7, is shown, but the present invention is not limited to this structure. That is, it is possible to be configured such that portions on the ends side of the respective lift cylinders 11*a* and 11*b* are connected to the lifter bracket 7.

That is, each end side of the respective lift cylinders 11*a* and 11*b* can be connected to the lifter bracket 7 such that the height position of the each one end of the lift cylinders 11*a* and 11*b* is substantially the same as that of the lifter bracket 7 as viewed from the side of the operating machine 31. In other words, it is possible to be configured such that each one end of the lift cylinders 11*a* and 11*b* may be disposed below a plane formed by connecting an eye point at a driver's seat of the motor grader defined in accordance with ISO and a tip end of the front frame 2 which can be seen from this eye point.

The other ends of the lift cylinders 11*a* and 11*b* are connected to the draw bar 3 through the second support means 21*a* and 21*b*. The second support means 21*a* and 21*b* are disposed between the support brackets 26*a* and 26*b* disposed on the draw bar 3 and the other ends of the lift cylinders 11*a* and 11*b*.

Connection positions between the draw bar 3 and the lift cylinders 11*a* and 11*b* is closer to the front side of the vehicle than connection positions between the lifter bracket 7 and the lift cylinders 11*a* and 11*b*. That is, as will be described later using FIG. 3, the each one end and each other end of the pair of lift cylinders 11*a* and 11*b* are disposed in a state of being offset in the longitudinal direction of the vehicle as viewed from above the vehicle.

The lifter bracket 7 is disposed such that it can turn with respect to the front frame 2. The rotation axis when the lifter bracket 7 is turned is disposed to be a straight line substantially passing through a turning point of the support means 24, which is a connection point between the front frame 2 and the draw bar 3. The rotation axis of the lifter bracket 7 will be explained later using later-described FIG. 3.

A draw bar shift cylinder 12 is disposed between the draw bar 3 and the lifter bracket 7. The lifter bracket 7 also has a function as a draw bar shift bracket 8 which connects to one end of the draw bar shift cylinder 12. One end of the draw bar shift cylinder 12 is connected to the lifter bracket 7 through the third support means 23*a*.

The other end of the draw bar shift cylinder 12 is connected to the draw bar 3 through the third support means 23*b*. The third support means 23*a* is disposed between the support bracket 27*a* provided on the lifter bracket 7 and one end of the draw bar shift cylinder 12 and the other third support means 23*b* is disposed between the support bracket 27*b* provided on the draw bar 3 and the other end of the draw bar shift cylinder 12.

A swing circle 9 is disposed on the draw bar 3 such that the swing circle 9 can swing. The swing circle 9 is swung and driven by a circle rotating machine 16 mounted on the draw bar 3. A blade 5 is laterally slidably supported by the swing circle 9. The blade 5 is provided with a slide rail 5*a*. The slide rail 5*a* is slidably supported by a blade support 9*a* mounted on the swing circle 9.

A side shift cylinder 13 is disposed between the blade support 9*a* and the blade 5. The blade 5 is supported by the blade support 9*a* by the expanding and contracting operation of the side shift cylinder 13, and the blade 5 can slide laterally. A tilt cylinder 14 is provided between the blade 5 and the swing circle 9, and a tilt angle of the blade 5 can be controlled.

Next, the operation of the operating machine will be explained. By simultaneously expanding and contracting the pair of lift cylinders 11*a* and 11*b*, the draw bar 3 can vertically swing around the support means 24 as a fulcrum. By differentiating the expanding and contracting movements of the lift cylinders 11*a* and 11*b*, the draw bar 3 can swing around a rotation axis connecting the support means 24 and the turning center of the lifter bracket 7. That is, the blade 5 can be turned in a state where one end of the blade 5 is raised and the other end thereof is lowered.

By expanding and contracting the draw bar shift cylinder 12, the draw bar 3 can swing in the right-and-left direction of the vehicle. By expanding and contracting the side shift cylinder 13, the blade 5 can slide laterally. By swinging the swing circle 9, the blade 5 can turn in the clockwise direction or counterclockwise direction when viewing the draw bar 3 from above the vehicle. The swinging angle of the blade 5 by the swing circle 9 can be 360° or more. By expanding and contracting the tilt cylinder 14, the tilt angle of the blade 5 can be controlled.

The pair of lift cylinders 11*a* and 11*b*, the draw bar shift cylinder 12, the side shift cylinder 13, the tilt cylinder 14 and the circle rotating machine 16 which swings the swing circle 9 can be driven independently from each other, or they can be driven in appropriate combination. With this, the direction, the inclination, and the like of the blade 5 can appropriately be adjusted in accordance with a ground surface and the like at a worksite.

The lifter bracket 7 can turn with respect to the front frame 2. The lifter bracket may be of a link-type. The link-type lifter bracket may employ a structure shown in FIG. 9 for example.

That is, the lifter bracket 35 includes a holding body 41 mounted on the front frame 2, a pair of support members 36*a* and 36*b* which is turnably connected to left and right portions of the holding body 41, and a link member 37 which is turnably connected to ends of the pair of support members 36*a* and 36*b*.

Figure 9:
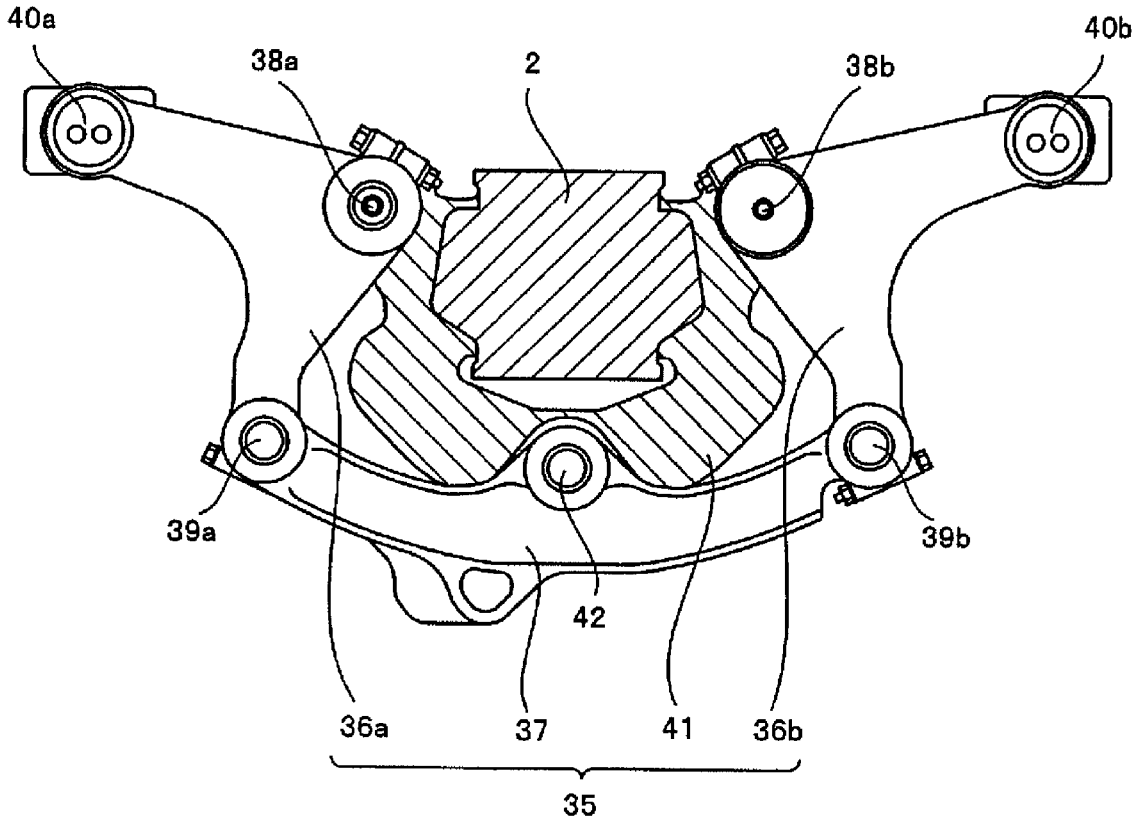
FIG. 9 is a sectional view showing another structure of the lifter bracket (embodiment 1).

FIG. 9 is a transverse sectional view of the lifter bracket 35 taken along a plane which is perpendicular to the axial direction of the front frame 2.

At this time the pair of support members 36*a* and 36*b* is turnably connected to the front frame 2 through turning shafts 38*a* and 38*b*, and are disposed in the right-and-left direction of the front frame 2. A lift cylinder (not shown) is turnably connected to the pair of support members 36*a* and 36*b* through connection portions 40*a* and 40*b*, respectively. The pair of support members 36*a* and 36*b* is turnably connected to both ends of the link member 37 through turning shafts 39*a* and 39*b*.

Turning shafts 38*a* and 38*b* in which the pair of support members 36*a* and 36*b* are turnably connected to the front frame 2, and turning shafts 39*a* and 39*b* in which a link member 37 is connected to the pair of support members 36*a* and 36*b* constitute a parallel link mechanism. An engagement position of the link member 37 with respect to the holding body 41 mounted on the front frame 2 can be adjusted by the positioning pin 42. By adjusting the engagement position by the positioning pin 42, it is possible to move the parallel link mechanism.

With this, as in the case where the lifter bracket 7 in the embodiment 1 is rotated around the front frame 2, it is possible to differentiate height positions of the pair of support members 36*a* and 36*b* from height positions of the lift cylinders 11*a* and 11*b* (not shown) in the connection portions 40*a* and 40*b* in FIG. 9. That is, by adjusting the engagement position between the link member 37 and the front frame 2, it is possible to assume a bank cut position with respect to the blade (not shown).

As shown in FIG. 1, when the lifter bracket 7 rotates, the expansion amount of the lift cylinder 11*a* or the lift cylinder 11*b* can also be shortened. That is, when explaining with reference to FIG. 1, it is supposed that the draw bar 3 swings in the clockwise direction as viewed from the driver's seat by the contracting operation of the lift cylinder 11*a* and the expansion operation of the lift cylinder 11*b*. At this time, the expanded length of the lift cylinder 11*b* is different between a case where the lifter bracket 7 does not turn with respect to the front frame 2 and a case where the lifter bracket 7 turns with respect to the front frame 2.

That is, the distance between the support bracket 25*b* of the lifter bracket 7 and the support bracket 26*b* of the draw bar 3 when the lifter bracket 7 does not turn with respect to the front frame 2 is longer than that when the lifter bracket 7 can turn with respect to the front frame 2. Therefore, when the lifter bracket 7 does not turn with respect to the front frame 2, the expansion amount of the lift cylinder 11*b* must be formed long.

When the lifter bracket 7 is configured such that it can turn with respect to the front frame 2, the expansion amount of the lift cylinder 11*b* can be formed short. An object of the present invention is to extremely reduce the visibility hindering portions of the pair of lift cylinders 11*a* and 11*b* which hinders the forward visibility and operation visibility in the motor grader. Therefore, a structure capable of shortening the lengths of the pair of lift cylinders 11*a* and 11*b* is a desirable structure.

Figure 2:
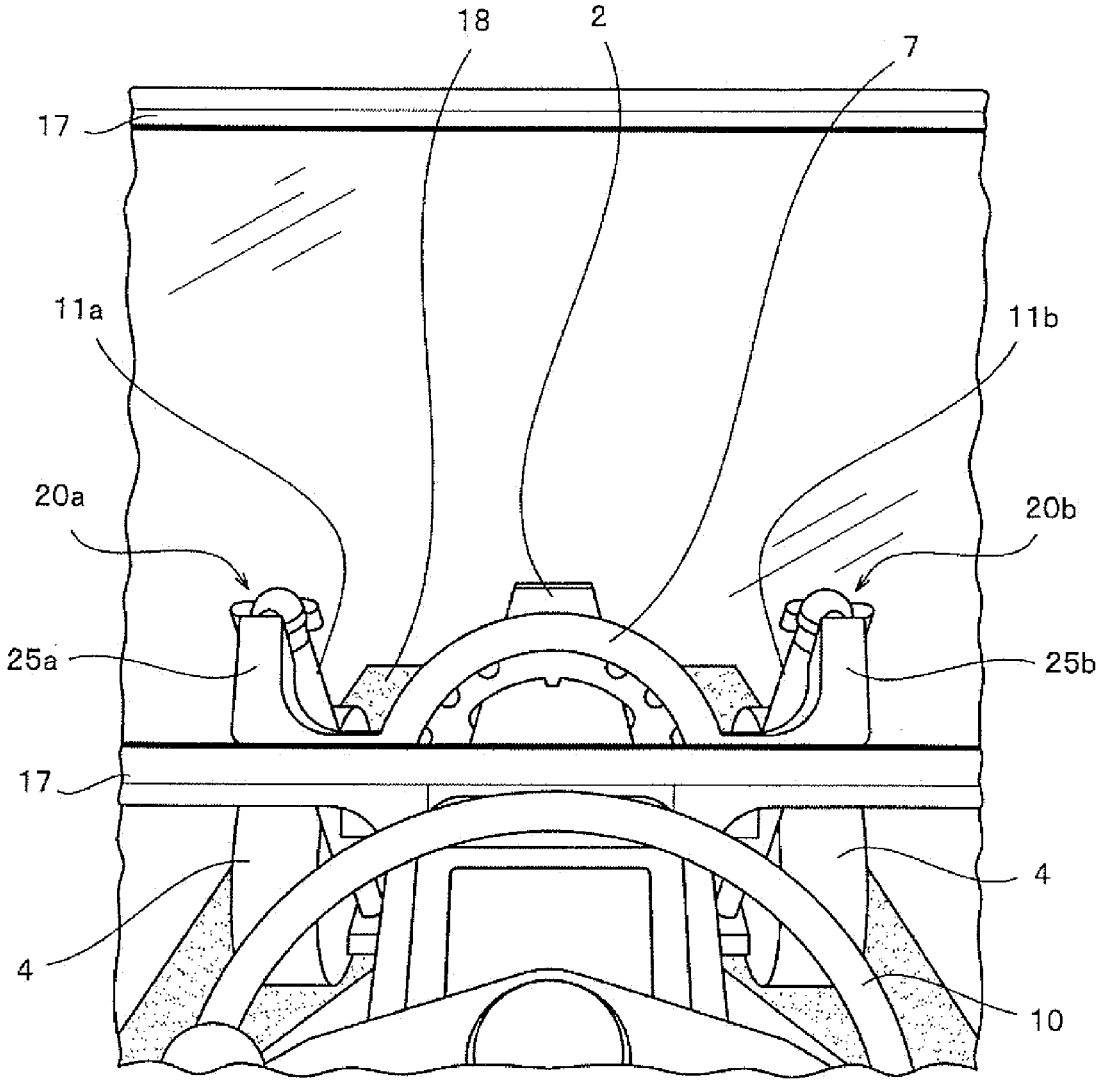
FIG. 2 is a perspective view of a forward visibility as viewed from a driver's seat (embodiment 1).

FIG. 2 is a front perspective view showing the forward visibility from the driver's seat. Since there are not projections of the lift cylinders 11*a* and 11*b* in front of the driver's seat, it is possible to widely see front. On the other hand, in the case of the conventional motor grader shown in FIG. 11, the pair of lift cylinders projects in front of the driver's seat, hindering the forward visibility.

Therefore, in the present invention, since the visibility hindering portions of the lift cylinders 11*a* and 11*b* can be made in a state of being extremely reduced, visibility of the forward road surface 18 and visibility on the side of the front wheel 4 are excellent.

The expansion states of the pair of lift cylinders 11*a* and 11*b* when the draw bar shift cylinder 12 shown in FIG. 1 is expanded and the draw bar 3 is swung in the right-and-left direction will be explained using FIG. 3. For comparison with the conventional example, the expansion states of the pair of lift cylinders 111*a* and 111*b* when the draw bar shift cylinder 112 shown in FIG. 10 is expanded and the draw bar 103 is swung in the right-and-left direction will be explained using FIG. 12. Concerning the symbols of the same members in FIG. 3 and FIG. 12, the members in FIG. 12 are designated with the number of the symbol used in FIG. 3 to which "100" is added.

Figure 3:
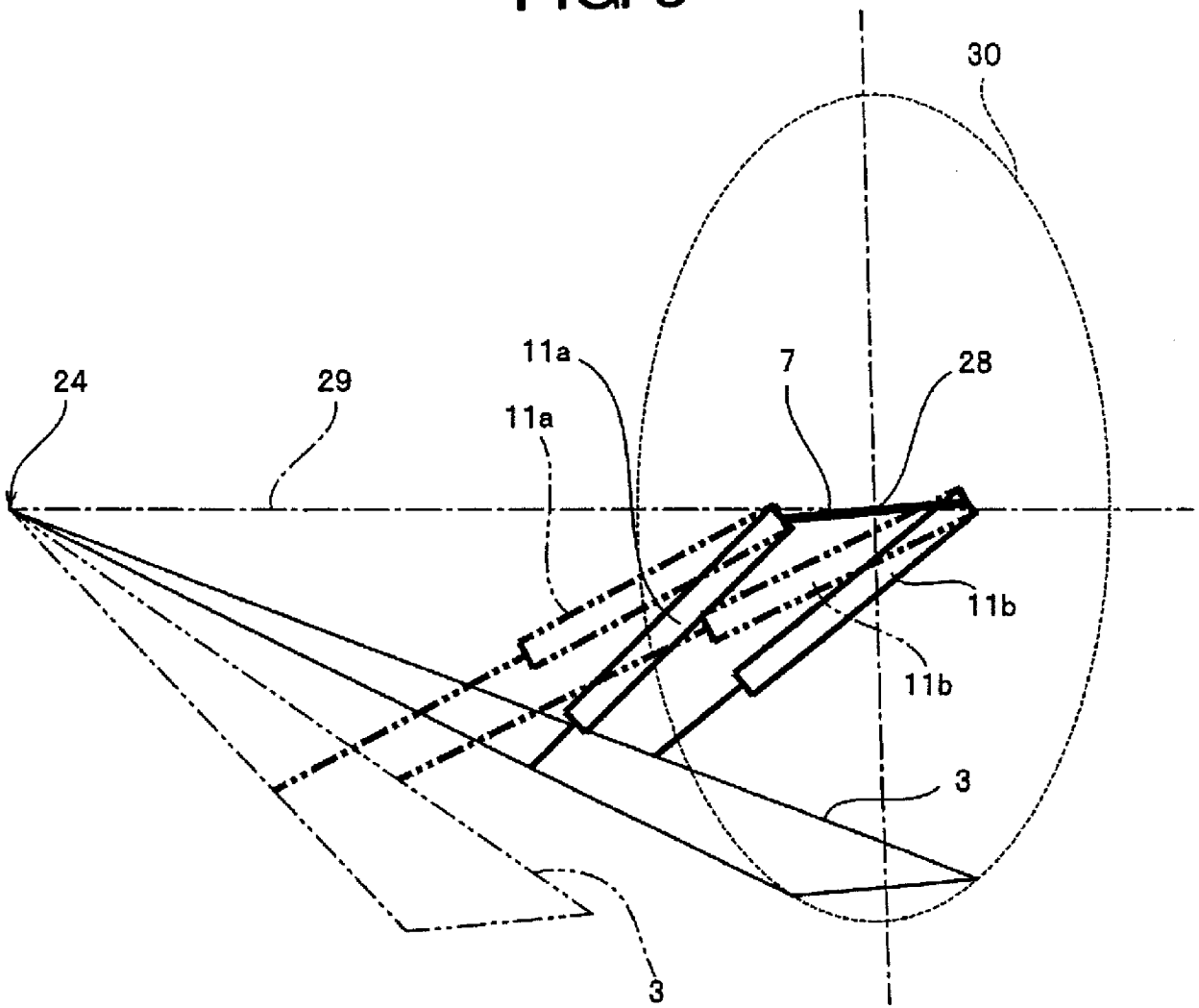
FIG. 3 is an explanatory diagram showing a swinging state of a draw bar (embodiment 1).

FIG. 3 is a schematic view of a position relation between the draw bar 3, the pair of lift cylinders 11*a* and 11*b* and the lifter bracket 7 in the motor grader of the present invention. FIG. 12 is a schematic view of a position relation of the members described above in the conventional motor grader.

In FIG. 3, the draw bar 3 can swing around the support means 24. In FIG. 12, the draw bar 103 can swing around the rotation center 124. In the case of FIGS. 3 and 12, the solid lines show the draw bars 3 and 103 in the neutral states, and the alternate long and two short dashes lines show states where the draw bars 3 and 103 swing leftward of the vehicle by the expansion of the draw bar shift cylinder 12 (see FIG. 1) and 112 (see FIG. 10). In FIG. 3, the lifter bracket does not rotate with respect to the front frame as in the conventional case shown in FIG. 12.

Figure 12:
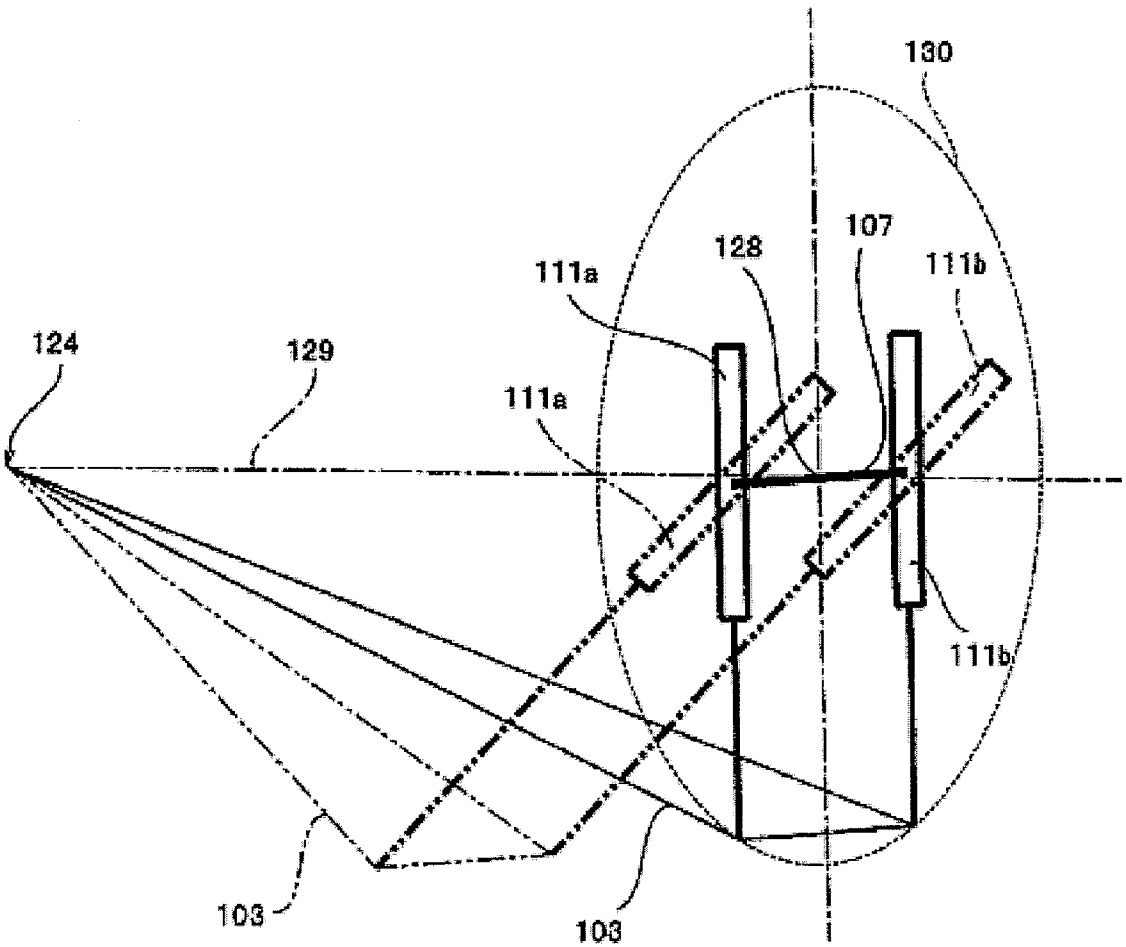
FIG. 12 PRIOR ART
FIG. 12 is an explanatory diagram showing a swinging state of the draw bar (conventional example).

In FIGS. 3 and 12, when the draw bars 3 and 103 are in the neutral states, the pair of lift cylinders 11*a* and 11*b* and the pair of lift cylinders 111*a* and 111*b* have the same lengths. If the draw bars 3 and 103 are swung leftward of the vehicle by the expansion of the draw bar shift cylinders 12 and 112 to assume the states shown with the alternate long and two short dashes lines, the lift cylinders 11*a* and 11*b* and the lift cylinders 111*a* and 111*b* are expanded.

The lengths of the alternate long and two short dashes lines which show the lift cylinders 11*a* and 11*b* and the lift cylinders 111*a* and 111*b* in FIGS. 3 and 12 are compared with each other. It can be seen that the lengths of the lift cylinders 11*a* and 11*b* shown in FIG. 3 are shorter than the lengths of the lift cylinders 111*a* and 111*b* shown in corresponding FIG. 12.

In FIG. 12, since the ends of the draw bar 103 have connection points with respect to the lift cylinders 111*a* and 111*b*, a distance between the draw bar bracket and the end of the draw bar 103 become greater with respect to the swinging of the draw bar 103 around the turning center 124 to the horizontal direction. On the contrary, in FIG. 3, the lift cylinders 11*a* and 11*b* are inclined with respect to the horizontal plane. Therefore, the lift cylinders 11*a* and 11*b* are connected to the draw bar 3 in a state where the lift cylinders 11*a* and 11*b* are inclined with respect to the horizontal plane. Therefore, even if the draw bar 3 swings in the horizontal direction around the support means 24 through the same angle, the distance from the draw bar bracket to the connection point of the draw bar 3 becomes shorter than that of the conventional example.

Figure 13:
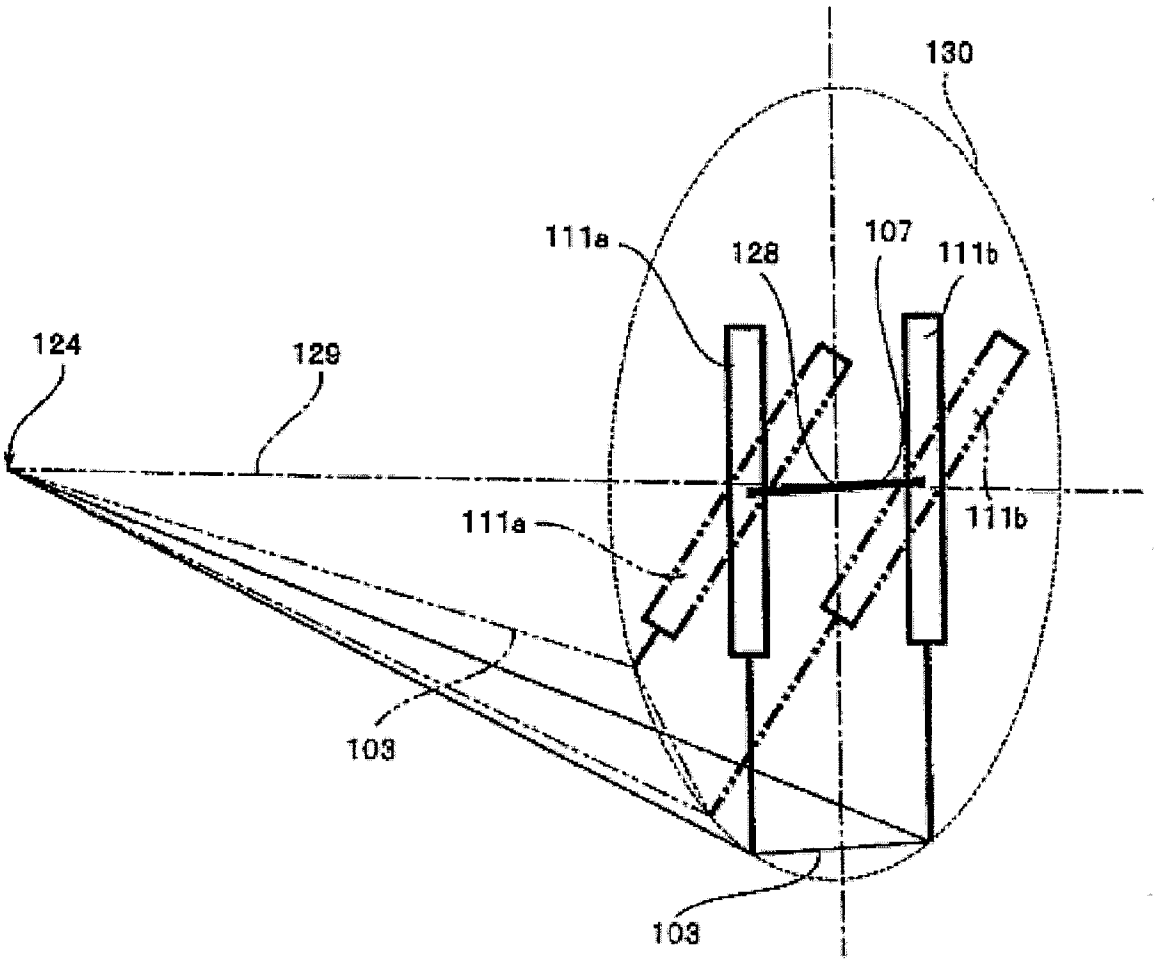
FIG.13 PRIOR ART
FIG. 13 is an explanatory diagram showing a turning state of the draw bar (conventional example).

Therefore, even if the lengths of the lift cylinders 11*a* and 111*b* are made shorter in the present invention, it is possible to swing the draw bar 3 in the horizontal direction through the same angle as in the conventional example. Similarly, even if the draw bar 3 is turned around the rotation axis 29, the lengths of the lift cylinders 11*a* and 11*b* can be formed shorter than those of the conventional lift cylinders 111*a* and 111*b*. Further, even if the lengths of the lift cylinders 11*a* and 11*b* are made shorter than the conventional lift cylinders 111*a* and 111*b*, the turning amount of the draw bar 3 around the rotation axis 29 can be the same as that of the conventional example. At this time, a swinging locus in the end of the draw bar 3 and the arc shown with the dotted line in FIG. 3 are the same swinging radius as that of a swinging locus 130 in the conventional example shown in the dotted line in FIGS. 12 and 13.

The lengths of the lift cylinders 11*a* and 11*b* can further be shortened by making the lifter bracket 7 turnable around the front frame. Therefore, in this invention, since the pair of lift cylinders 11*a* and 11*b* is connected to the draw bar 3 in a state where the lift cylinders 11*a* and 11*b* are inclined with respect to the horizontal plane, even if portions of the lift cylinders 11*a* and 11*b* project from the upper surface of the lifter bracket 7, the projections above the lifter bracket 7 does not hinder the forward visibility.

Figure 11:
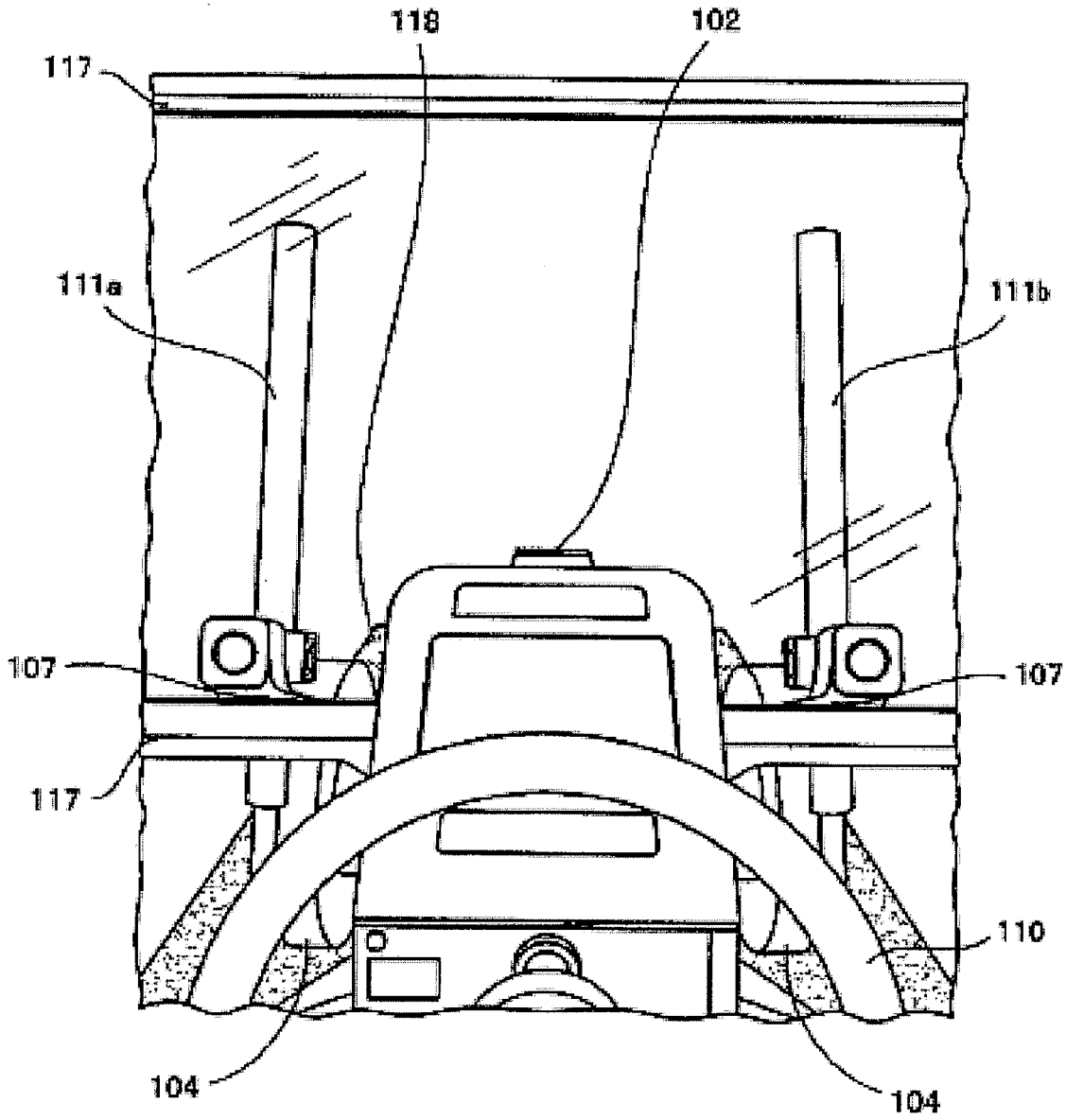
FIG. 11 PRIOR ART
FIG. 11 is a perspective view of a forward visibility as viewed from a driver's seat (conventional example).

Especially, as will be apparent by comparing FIGS. 2 and 11, the forward visibility and operation visibility from the driver's seat can largely be enhanced.

Embodiment 2

Figure 4:
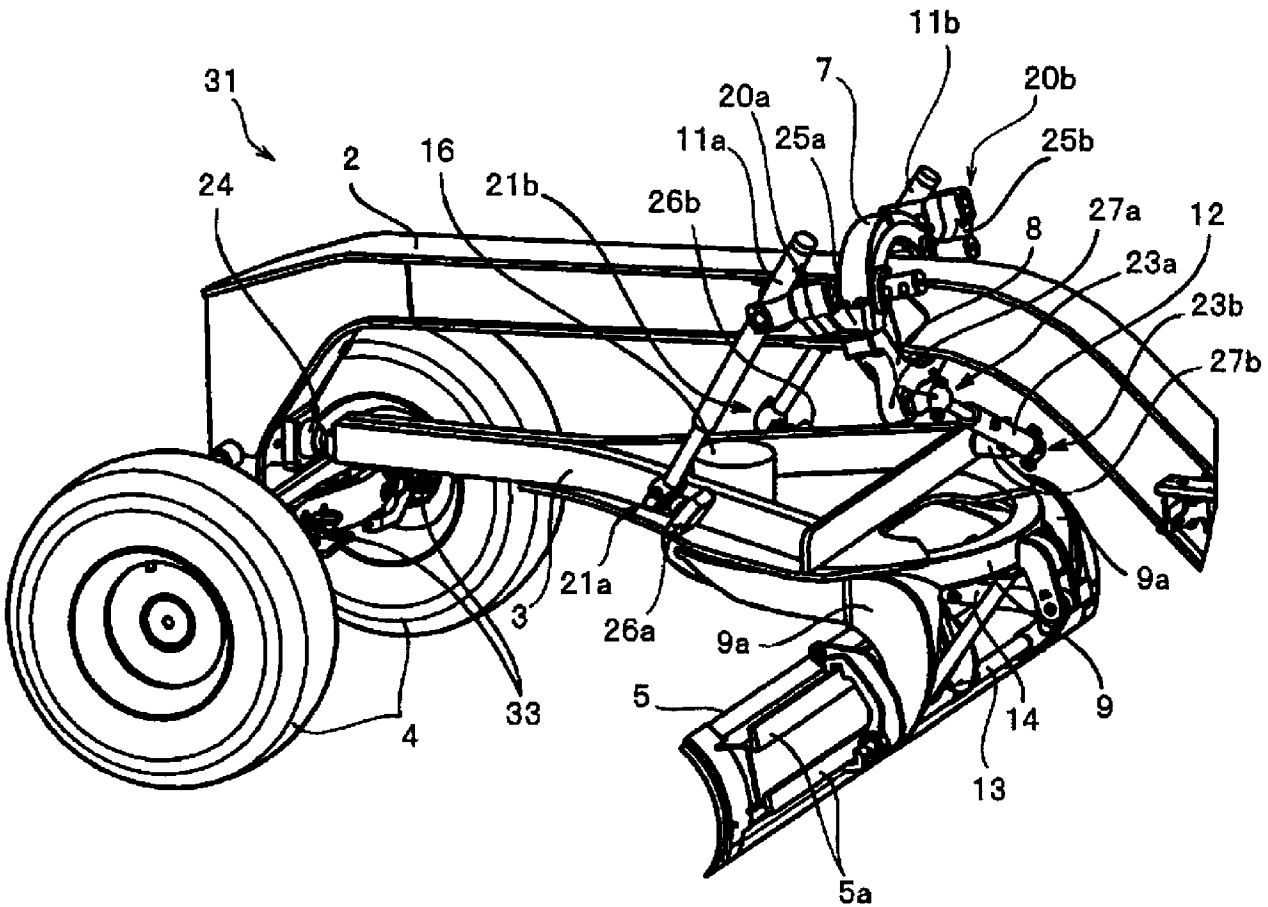
FIG. 4 is a perspective view showing an operating machine section of the motor grader (embodiment 2).

FIG. 4 shows another embodiment of the present invention. Although the one ends of the lift cylinders 11*a* and 11*b* are connected to the lifter bracket 7 in the embodiment 1, portions of one ends of the pair of lift cylinders 11*a* and 11*b* are connected to the lifter bracket 7 in the embodiment 2. It is desirable that one end which is a connection portion is a portion of a cylinder tube which is at most apart from the one end of the cylinder tube about ⅓ of the length of the cylinder tube.

Support means of trunnion mechanisms are used as the first support means 20*a* and 20*b* which connect the lifter bracket 7 and the lift cylinders 11*a* and 11*b*. The embodiment 2 is different from the embodiment 1 in this structure.

Other structure is the same as that of the embodiment 1. Concerning the same structure as that of the embodiment 1, the same member reference symbols as those used in the embodiment 1 are used and explanation thereof will be omitted. The lifter bracket 7 also has a function as the draw bar shift bracket 8 which is connected to one end of the draw bar shift cylinder 12. The height positions of one ends of the lift cylinders 11*a* and 11*b* are substantially the same as the height position of the lifter bracket 7 as viewed from the side.

As shown in FIG. 4, the pair of lift cylinders 11*a* and 11*b* can be shorter than the conventional lift cylinders as explained in the embodiment 1, and the lifter bracket 7 can turn with respect to the front frame 2. Therefore, the pair of lift cylinders 11*a* and 11*b* can be shortened in length. The lift cylinders 11*a* and 11*b* are disposed in a state where they are inclined with respect to the horizontal plane.

With this, as shown in FIG. 4, the lift cylinders 11*a* and 11*b* are inclined with respect to the horizontal plane, and even if portions of the lift cylinders 11*a* and 11*b* project above the upper surface of the lifter bracket 7 when the portions of the one ends of the lift cylinders 11*a* and 11*b* are connected to the lifter bracket 7, the projection from the lifter bracket does not hinder the forward visibility.

Therefore, even when the portions of the one ends of the lift cylinders 11*a* and 11*b* are connected to the support brackets 25*a* and 25*b* of the lifter bracket 7 through the first support means 20*a* and 20*b* as shown in FIG. 4, it is possible to prevent the forward visibility and operation visibility from being hindered from the driver's seat.

Embodiment 3

Figure 5:
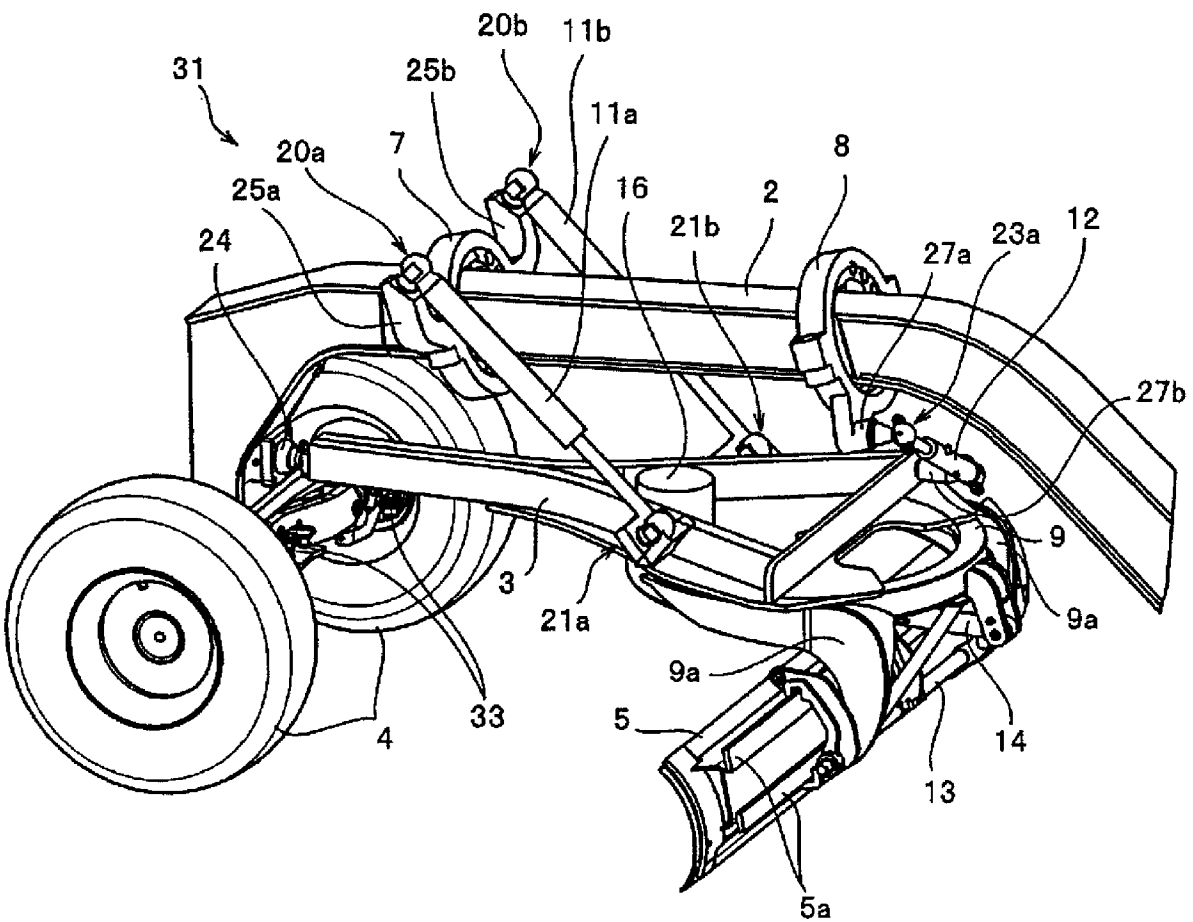
FIG. 5 is a perspective view showing an operating machine section of the motor grader (embodiment 3).

FIG. 5 shows another embodiment of the present invention. In the embodiment 3, the pair of lift cylinders 11*a* and 11*b* is inclined in the opposite direction from the embodiment 1. That is, the connection point with the draw bar 3 with respect to the lifter bracket 7 is disposed on the rear side of the vehicle. The draw bar shift bracket 8 which is connected to the one end of the draw bar shift cylinder 12 is rotatably disposed on the front frame 2. The embodiment 3 is different from the embodiment 1 in this structure.

Other structure is the same as that of the embodiment 1. Concerning the same structure as that of the embodiment 1, the same member reference symbols as those used in the embodiment 1 are used and explanation thereof will be omitted.

As shown in FIG. 5, the lifter bracket 7 is disposed on the front frame 2 on the front side of vehicle, and the draw bar shift bracket 8 is disposed near a portion of the front frame 2 on which the lifter bracket 7 is disposed in FIG. 1. One ends of the pair of lift cylinders 11*a* and 11*b* are connected to the support brackets 25*a* and 25*b* of the lifter bracket 7 through the first support means 20*a* and 20*b*, respectively. The height positions of one ends of the lift cylinders 11*a* and 11*b* are substantially the same as the height position of the lifter bracket 7 as viewed from the side.

The other ends of the lift cylinders 11*a* and 11*b* are connected to the support brackets 26*a* and 26*b* of the draw bar 3 through the second support means 21*a* and 21*b*, respectively. The one ends of the lift cylinders 11*a* and 11*b* are disposed on the front side of the vehicle, and the other ends are disposed on the rear side.

Both the lifter bracket 7 and the draw bar shift bracket 8 can rotate with respect to the front frame 2. When the draw bar 3 swings around a rotation axis connecting the support means 24 connected to the tip end of the draw bar 3 and the rotation center of the draw bar shift bracket 8, the draw bar shift bracket 8 and the lifter bracket 7 can rotate around the front frame 2.

When the draw bar 3 swings rightward and leftward along the horizontal plane, the lifter bracket 7 is rotated with respect to the front frame 2, and the draw bar shift bracket 8 cannot rotate with respect to the front frame. The lifter bracket 7 can also be rotated by a rotation moment force from the lift cylinders 11*a* and 11*b*.

With this, the draw bar 3 can swing in the same manner as that of the conventional motor grader, and it is possible to prevent the forward visibility and operation visibility from being hindered by the lift cylinders 11*a* and 11*b*. Since the lifter bracket 7 is disposed on the front side of the vehicle, the shielding amount of the sides of the front wheels 4 by the lift cylinders 11*a* and 11*b* are reduced, and the visibility on the sides of the front wheels 4 can further be enhanced.

Embodiment 4

Figure 6:
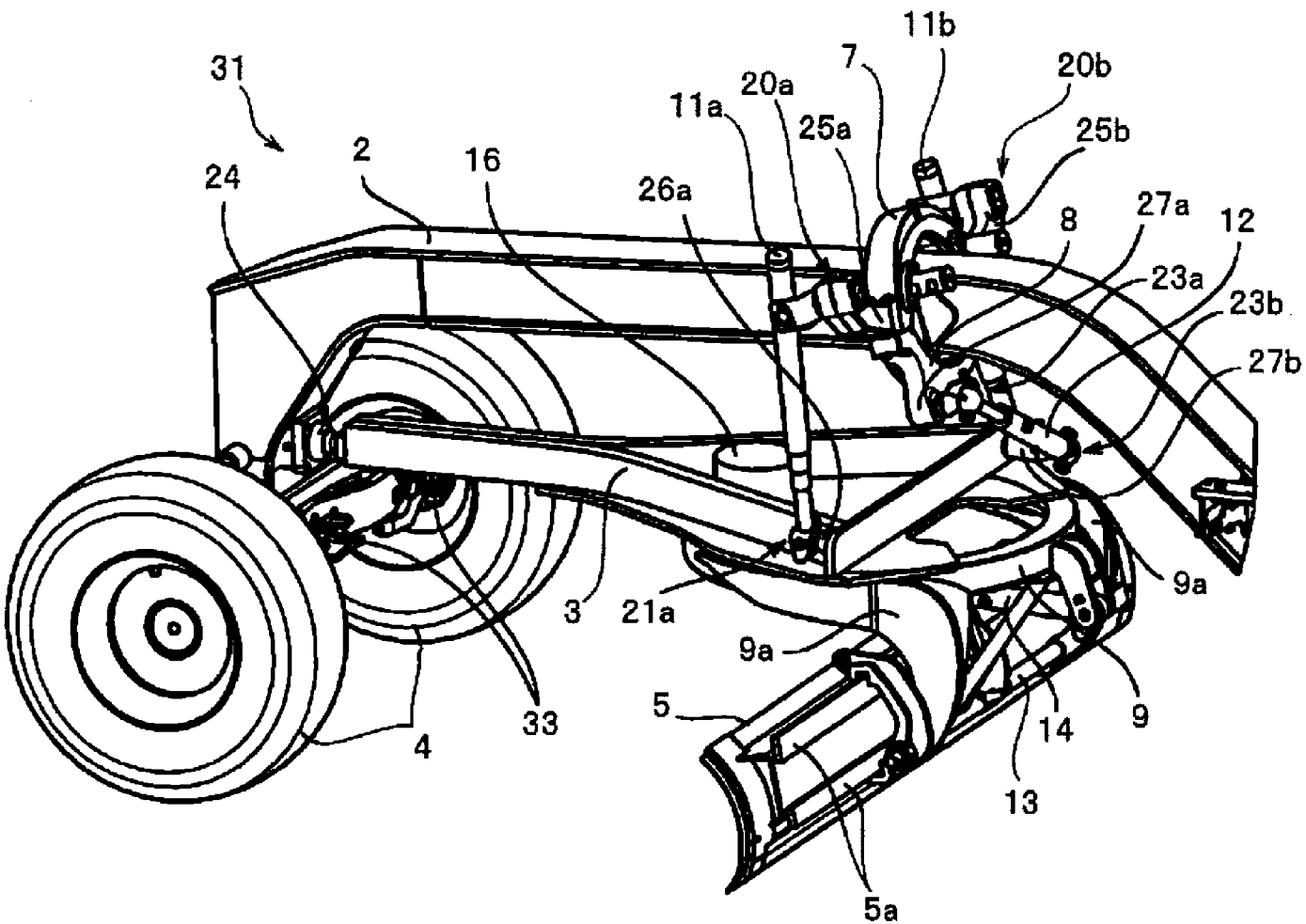
FIG. 6 is a perspective view showing an operating machine section of the motor grader (embodiment 4).

FIG. 6 shows another embodiment of the present invention. In the embodiment 4, the pair of the lift cylinders 11*a* and 11*b* is a telescopic cylinder. The pair of lift cylinders 11*a* and 11*b* and the draw bar 3 are disposed on the rear end side of the draw bar 3 as in the conventional example. That is, the pair of lift cylinders 11*a* and 11*b* is disposed so as to be directed substantially in the vertical direction like the conventional example. The embodiment 4 is different from the embodiment 2 in these points.

Other structure is the same as that of the embodiment 2. Concerning the same structure as that of the embodiment 2, the same member reference symbols as those used in the embodiment 2 are used and explanation thereof will be omitted. The lifter bracket 7 also has a function as the draw bar shift bracket 8 which is connected to one end of the draw bar shift cylinder 12. The height positions of one ends of the lift cylinders 11*a* and 11*b* are substantially the same as the height position of the lifter bracket 7 as viewed from the side.

Since the pair of lift cylinders 111*a* and 11*b* is configured as a multistage cylinder of a telescopic type, the lengths of the pair of lift contracted cylinders 11*a* and 11*b* can be shortened. Therefore, even if the ends of the lift cylinders 11*a* and 11*b* are connected to the rear end of the draw bar 3 and portions of the lift cylinders project above the upper surface of the lifter bracket 7 as in the conventional example, the portions of the lift cylinders projecting above the lifter bracket 7 have such lengths that forward visibility and operation visibility are not hindered.

Since the lift cylinders 11*a* and 11*b* are configured as a multistage cylinder, even if the draw bar 3 swings around the support means 24, the lift cylinders 11*a* and 11*b* have such lengths that the lift cylinders can follow the swinging motion of the draw bar 3.

Therefore, it is possible to enhance the forward visibility and operation visibility, and to swing the draw bar 3 as in the conventional motor grader.

Embodiment 5

Figure 7:
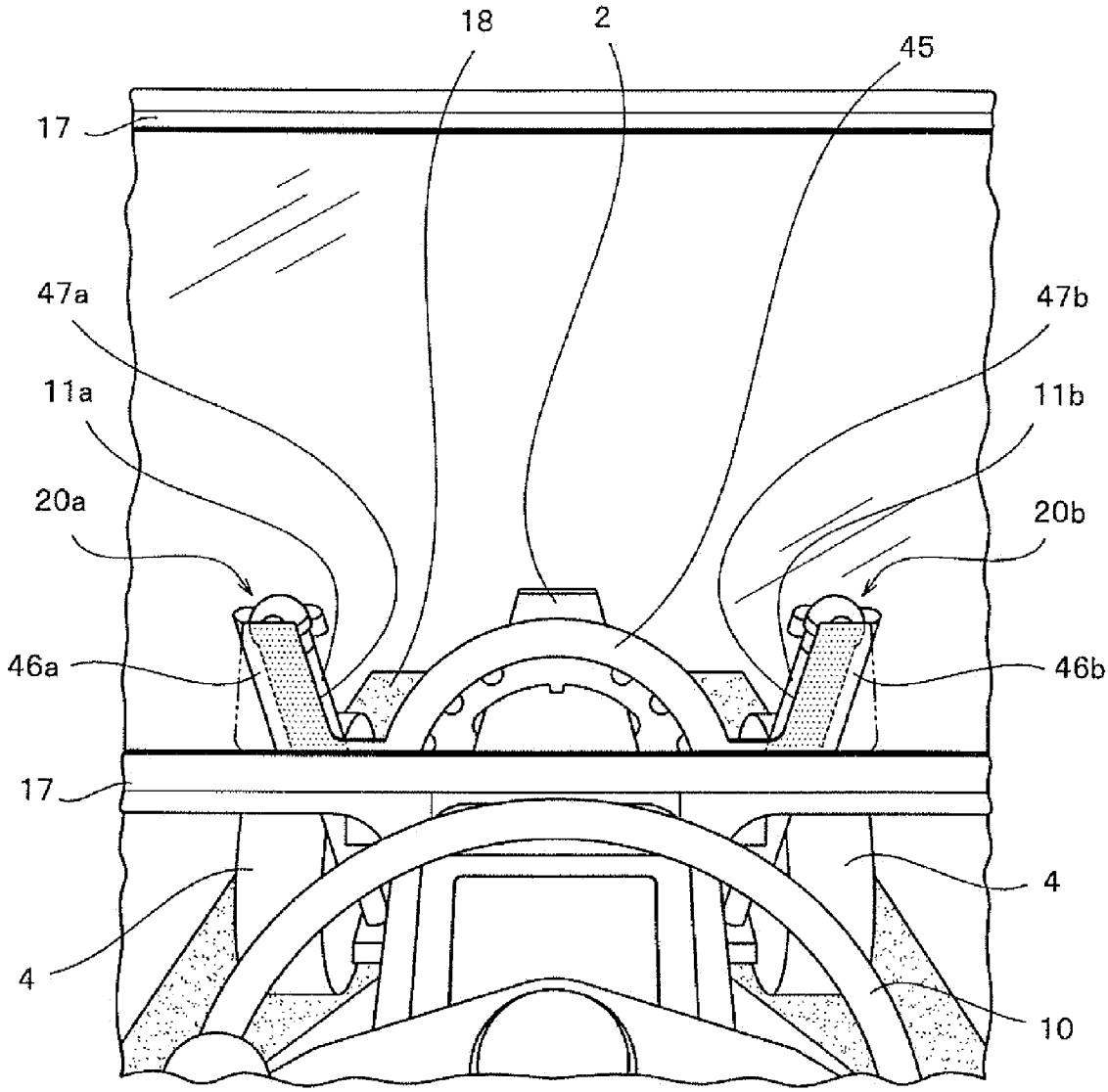
FIG. 7 is a perspective view of a forward visibility as viewed from a driver's seat (embodiment 5).
Figure 8:
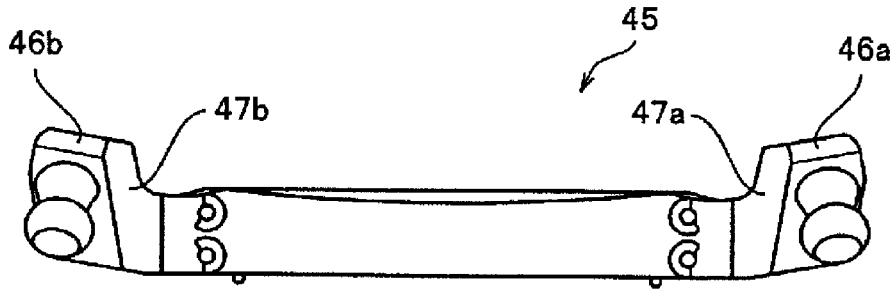
FIGS. 8(*a*) and (*b*) are plan views showing structures of the lifter bracket used in FIGS. 7 and 2 (embodiment 5).
Figure 8:
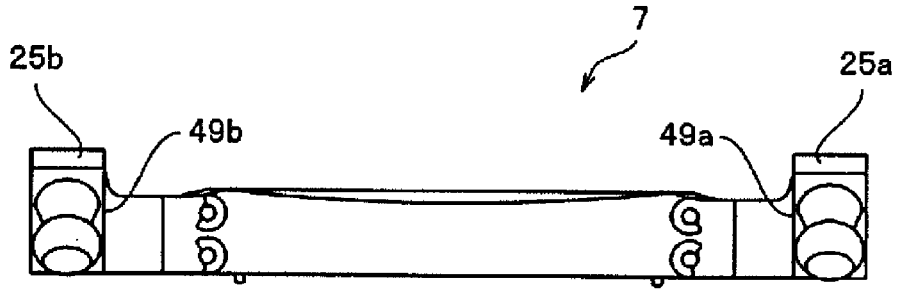

FIG. 7 shows another embodiment of the present invention, and is a front perspective view as viewed from the driver's seat. FIG. 8(*a*) is a plan view of a lifter bracket 45 used in the embodiment 5 as viewed from above. In the embodiment 5, in a pair of support brackets 46*a* and 46*b* disposed on the lifter bracket 45, opposed side surfaces 47*a* and 47*b* of the pair of support brackets 46*a* and 46*b* stand on the paper sheet and incline in opposite directions from each other as shown in FIG. 8(*a*).

That is, in the lifter bracket 7 shown in FIG. 2 in the embodiment 1, as shown in FIG. 8(*b*) which is a plan view of the lifter bracket 7 as viewed from above, opposed side surfaces 49*a* and 49*b* of the pair of support brackets 25*a* and 25*b* are formed as parallel surfaces which stand on the paper sheet. The pair of support brackets 46*a* and 46*b* in the embodiment 5 has different structures as those of the embodiment 1. The height positions of the one ends of the lift cylinders 11*a* and 11*b* as viewed from the side are substantially the same height position of the lifter bracket 7.

Other structure is the same as that of the embodiment 1. Concerning the same structure as that of the embodiment 1, the same member reference symbols as those used in the embodiment 2 are used and explanation thereof will be omitted.

In the embodiment 5, the opposed side surfaces 47*a* and 47*b* of the pair of support brackets 46*a* and 46*b* are formed as surfaces which stand on the paper sheet and which have opposite inclinations from each other. Therefore, as shown in FIG. 7, there is a surface of projection region where a surface of projection of each of the lift cylinders 11*a* and 11*b* and a surface of projection of each of the pair of support brackets 46*a* and 46*b* are superposed at least partially. In this surface of projection region, an area of a portion where the pair of support brackets 46*a* and 46*b* and the lift cylinders 11*a* and

11*b* are superposed on each other can be larger than an area where they are not superposed on each other.

In FIG. 7, the areas where the pair of support brackets 46*a* and 46*b* and the lift cylinders 11*a* and 11*b* are superposed on each other are shown with matrix dots.

That is, when the widths of the pair of support brackets 25*a* and 25*b* shown in FIG. 2 are the same as those of the pair of support brackets 46*a* and 46*b*, the left end edge of the support bracket 25*a* in FIG. 2 can be shown with the alternate long and two short dashes line shown on the left side of the support bracket 46*a* in FIG. 7. In other words, if the opposed side surfaces 47*a* and 47*b* of the pair of support brackets 46*a* and 46*b* are formed as surfaces which are inclined in the opposite directions from each other, in the front perspective view in FIG. 7, a hinder region of the forward visibility which is hindered by the lift cylinders 11*a* and 11*b* and the pair of support brackets 46*a* and 46*b* can be smaller than the forward visibility hinder region in FIG. 2.

Further, as shown in FIG. 7, the opposed side surfaces 47*a* and 47*b* of the pair of support brackets 46*a* and 46*b* can be disposed as shown with the straight lines in FIG. 7. The side surfaces 47*a* and 47*b* shown with the straight lines can be disposed in parallel to side edges of the lift cylinders 11*a* and 11*b*. With this, the forward visibility hindrance region which is hindered by the lift cylinders 11*a* and 11*b* and the pair of support brackets 46*a* and 46*b* can further be reduced.

As shown in FIGS. 8(*a*) and (*b*), the distance between support portions which support the lift cylinders 11*a* and 11*b* at the pair of support brackets 46*a* and 46*b* in FIG. 8(*a*) can be wider than a distance between support portions which support the lift cylinders 11*a* and 11*b* at the pair of support brackets 25*a* and 25*b* in FIG. 8(*b*). With this, the lift cylinders 11*a* and 11*b* can further be inclined in the right-and-left direction of the operating machine 31, and the lift cylinders 11*a* and 11*b* can be shortened in length as compared with the embodiment 1.

In the front perspective view from the driver's seat, the structure of embodiment 5 in which the area where the pair of support brackets 25*a* and 25*b*, 46*a* and 46*b*, and the lift cylinders 11*a* and 11*b* are superposed on each other is larger than the area where they are not superposed can also be employed in the structures of the embodiments 2 to 4, in addition to the structure of the embodiment 1.

In the embodiments 1, 2, 4 and 5, the pair of support brackets 25*a* and 25*b* or the pair of support brackets 46*a* and 46*b* are disposed in front of the lift cylinders 11*a* and 11*b* as viewed from the driver's seat. Alternatively, the lift cylinders 11*a* and 11*b* may be disposed in front of them. Further, in the embodiment 3, the lift cylinders 11*a* and 11*b* are disposed in front of the support brackets 25*a* and 25*b* as viewed from the driver's seat, but the pair of support brackets 25*a* and 25*b* may be disposed in front of the lift cylinders 11*a* and 11*b*.

In these structures also, in the front perspective view from the driver's seat, it is preferable that the area where the pairs of support brackets 25*a* and 25*b*, and 46*a* and 46*b* and the lift cylinders 11*a* and 11*b* are superposed on each other is larger than the area where they are not superposed on each other.

INDUSTRIAL APPLICABILITY

The technical idea of the present invention can be preferably applied to a motor grader using a pair of lift cylinders.

The invention claimed is:

1. A motor grader comprising:

a front frame on which a lifter bracket is disposed, the lifter bracket disposed rotatably around the front frame, and the front frame disposed at a rotation center of the lifter bracket;

a draw bar turnably connected to the front frame and rotatably supports a blade at its lower surface;

a pair of left and right lift cylinders lifting up and down the draw bar, wherein:

a swing circle is disposed at the lower surface of the draw bar and a circle rotating machine to swing the swing circle is provided on a forwardmost portion of the swing circle;

each one end of the respective lift cylinders is respectively connected to the lifter bracket through first support means having a degree of freedom of two or more;

each other end of the respective lift cylinders is respectively connected to a forward portion in the draw bar being adjacent to the circle rotating machine through second support means having a degree of freedom of two or more;

wherein the second support means when viewed from a side view of the motor grader overlaps the circling rotating machine; and each one end and each other end of the respective lift cylinders are offset on a front-rear side of the motor grader as viewed from above the motor grader.

2. The motor grader according to claim 1, wherein each one end of the respective lift cylinders is offset on a forward side of the motor grader with respect to each other end of the respective lift cylinders as viewed from above the motor grader.

3. The motor grader according to claim 1, wherein each one end of the respective lift cylinders is offset on a rearward side of the motor grader with respect to each other end of the respective lift cylinders as viewed from above the motor grader.

4. The motor grader according to claim 1, wherein:

a pair of support brackets which supports the respective lift cylinders through the first support means are disposed on a portion of the lifter bracket in a right-and-left direction of the motor grader, and a disposition relation between the respective lift cylinders and the pair of support brackets is configured such that, of a whole projected area formed by surfaces of projections of the respective lift cylinders and surfaces of projections of the pair of support brackets in a front perspective view of the motor grader as viewed from a driver's seat, a projected area in a region where the surfaces of the projections are superposed with each other is bigger than a projected area in a region in which the surfaces of the projections are not superposed with each other.

* * * * *